United States Patent [19]

Kircher

[11] 4,009,679

[45] Mar. 1, 1977

[54] DISPLAY FOR A SIMULATED FOOTBALL GAME

[76] Inventor: John G. Kircher, 1010 Kinmont Ave., Cincinnati, Ohio 45208

[22] Filed: Oct. 9, 1975

[21] Appl. No.: 621,161

[52] U.S. Cl. ..... 116/120; 116/135; 273/94 R

[51] Int. Cl.[2] ..... A63B 71/06

[58] Field of Search ..... 273/94 R, 134 CF; 116/120, 135; 40/13, 14, 16.6

[56] References Cited

UNITED STATES PATENTS

| | | | |
|---|---|---|---|
| 824,516 | 6/1906 | Suesskind | 40/16.6 |
| 1,668,389 | 5/1928 | Vigneron | 116/120 |
| 1,675,619 | 7/1928 | Sorlien | 273/94 R |
| 1,708,055 | 4/1929 | Dellmuth | 40/16.6 |
| 1,747,065 | 2/1930 | Elliott | 273/94 R |
| 2,044,506 | 6/1936 | Lundquist | 273/94 R |
| 2,230,767 | 2/1941 | Strattman | 273/94 R |
| 2,505,382 | 4/1950 | Bridges | 116/120 |
| 2,600,940 | 6/1952 | Tullio | 273/94 R |

*Primary Examiner*—Anton O. Oechsle
*Assistant Examiner*—Harry G. Strappello
*Attorney, Agent, or Firm*—James W. Pearce; Roy F. Schaeperklaus

[57] ABSTRACT

A display for a simulated football game. The display includes an elongated main panel having yard marking indicia arranged therealong. Edge panels mounted on the main panel support clips which are movable therealong. An indicator member mounted on each of the clips is alignable with selected yard marking indicia.

3 Claims, 5 Drawing Figures

SWEEP GAINS 8-YARDS
15-YARD GAIN ON DRAW PLAY +
OFFENSE OFFSIDES
LOSE 5-YARDS
SHORT PASS
5-YARDS +

BALL
10 YARDS
DOWN
1 2 3 4

DISPLAY FOR A SIMULATED FOOTBALL GAME

This invention relates to a game device. More particularly, this invention relates to a display for a simulated football game.

An object of this invention is to provide a simple display device for a football type game for use in association with a play selector.

A further object of this invention is to provide a display which includes a backing member on which yard markers are indicated and along which indicators can be advanced to indicate a position of a ball and a position of a ten-yard subdivision required for a first down.

Briefly, this invention provides a display which includes a base plate and a display member attached to the base plate. Yard markers are indicated on the display member. Edge portions of the display member project upwardly and away from a central display panel of the display member. Clip members can be mounted on the edge portions of the display member and can be advanced therealong to indicate a ball position and a section of ten-yards for a first down. An edge portion of the base plate is exposed and can be gripped to hold the display during moving of the clip members. The display can be used in connection with a play selector, which can be in the nature of a dart board with sections of the dart board marked to indicate selected plays.

The above and other objects and features of this invention will be apparent to those skilled in the art to which this invention relates from the following detailed description and the drawing, in which.

In the following detailed description and the drawings, like reference characters indicate like parts.

Figures 1, 2, 3, 4, 5:
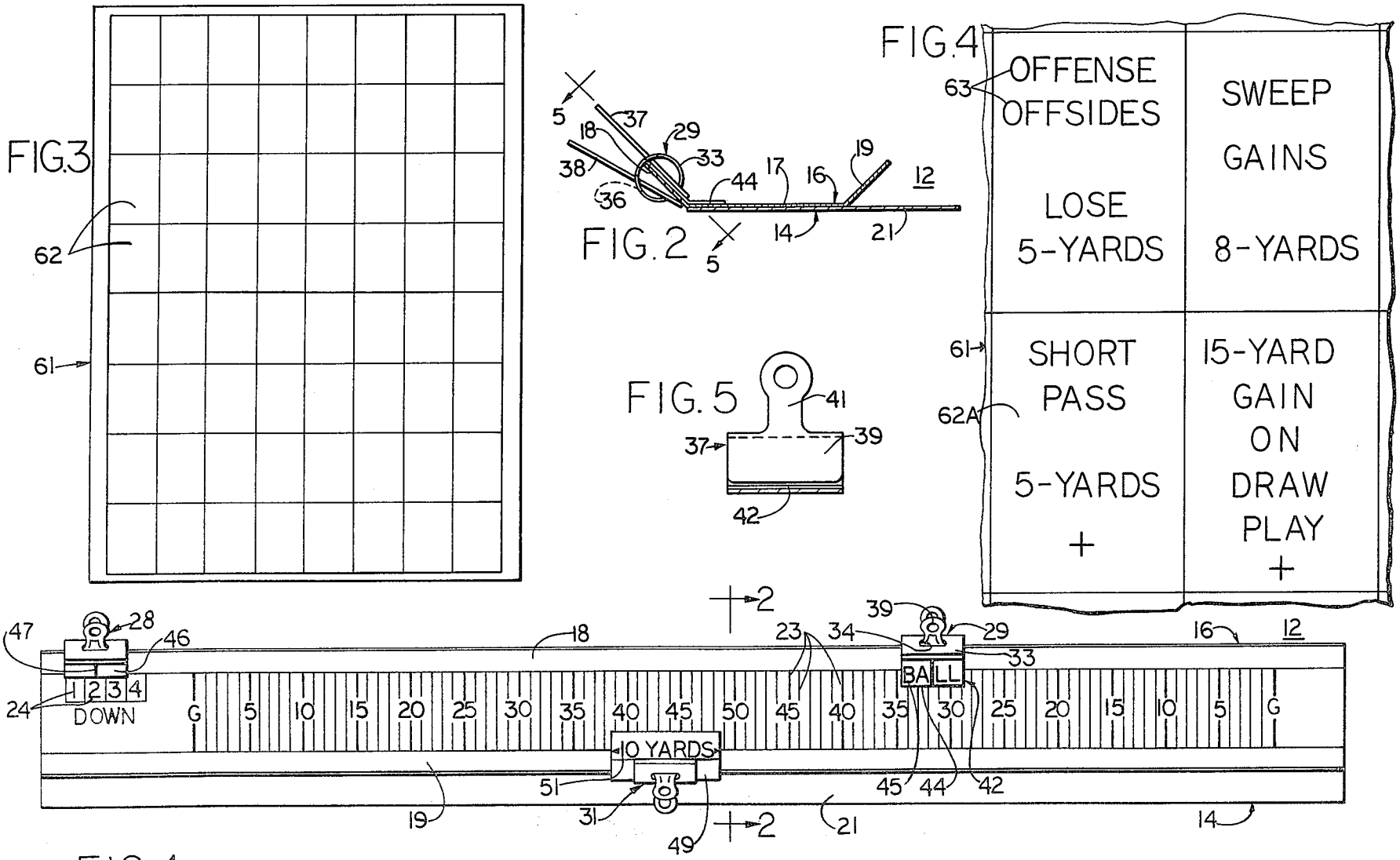
FIG. 1 is a plan view of a display device constructed in accordance with an embodiment of this invention.
FIG. 2 is a view in section taken generally on the line 2—2 in FIG. 1.
FIG. 3 is a view in side elevation of a dart board for use in association with the display device.
FIG. 4 is an enlarged fragmentary view in side elevation of the dart board shown in FIG. 3.
FIG. 5 is a side elevational view of a clamping plate of the device taken in the direction of arrows 5—5 in FIG. 2.

In FIGS. 1 and 2 is shown a display 12 for a football type game, which is constructed in accordance with an embodiment of this invention. The display device 12 includes an elongated flat base plate 14 and a display member 16 mounted on the base panel 14. The display member 16 includes a central panel 17 (FIG. 2) which extends the length of the base plate 14 and is attached in face-to-face relation therewith by a suitable adhesive or the like. Edge panel portions 18 and 19 of the display member 16 extend upwardly and outwardly from the central panel 17 as shown in FIG. 2 at an angle of approximately 45 degrees thereto. A lengthwise edge portion 21 of the base plate 14 is exposed beneath the edge portion 19 of the display member 16. Indicia 23 (FIG. 1) is arranged along the central panel 17 of the display member 16 to indicate yard markers of a conventional football field. At one end section of the edge portion 18 of the display member 16 is arranged indicia 24 to indicate the down.

Clips 28 and 29 are mounted on the edge portion 18 of the display member 16, and a clip 31 is mounted on the edge portion 19 of the display member 16. The clips 28, 29 and 31 are of similar construction. As shown in FIGS. 1 and 2, the clip 29 includes a C-shaped spring 33 provided with openings 34 (FIG. 1) and 36 (FIG. 2). Clamp plate members 37 and 38 are engaged by the spring 33. As shown in FIG. 5, the clamp plate member 37 is generally T-shaped and includes a main portion 39 and a staff portion 41. The staff portion 41 extends through the opening 34. The spring 33 urges the clamp plate members to a closed position in which outer edges of the main portions of the clamp plate members are in opposed gripping relation. A portion of the indicator card 42 is adhesively attached to the main portion 39 with an edge portion 44 of the card 42 exposed as shown in FIGS. 1 and 2. The exposed edge portion 44 bears indicia 45 (FIG. 1) for showing a ball location. The edge portion 44 projects in a direction to lie in face-to-face relation with the central panel 17 of the display member 16 as shown in FIG. 2. The clip 28 (FIG. 1) carries a card 46 which has an indicia mark 47 for indicating a down. The clip 31 carries a card 49 which carries indicia 51 to indicate a 10-yard distance along the display device. The clips 28, 29 and 31 can be moved along the display member 16 for keeping track of the plays of the simulated football game. The edge portion 21 of the base plate 14 can be held with one hand while the other hand is used to manipulate the clips.

Play selection can be made by use of a dart board 61 (FIGS. 3 and 4) which has a face which is divided into a plurality of sections 62. Otherwise the dart board 61 can be of conventional construction, and the dart board has not been shown in detail. Each of the sections 62 can be provided with indicia 63 to indicate a particular play. A player throws a dart (not shown) at the board 61 and, if the dart lands in the section 62A (FIG. 4), the ball indicating clip 29 (FIG. 1) is advanced 5 yards and the down indicating clip 28 is advanced to indicate the correct down. When a first down is made, the clip 31 is advanced to show the location for the next first down.

The display device for a simulated football game which has been illustrated in the drawing and described above is subject to structural modification without departing from the spirit and scope of the appended claims.

Having described my invention, what I claim as new and desire to secure by letters patent is:

1. A display for a simulated football game which comprises a display member including an elongated main panel and a pair of edge panels, the edge panels being mounted on and extending along opposite lengthwise edges of the main panel, the edge panels projecting upwardly and outwardly of the main panel, yard marking indicia arranged along the main panel, a plurality of spring clips mounted on the edge panels and movable therealong, at least one of the spring clips being mounted on each edge panel, a display gripping panel having a main portion mounted in face-to-face relation to the main panel and a gripping edge portion extending outwardly from one edge of the main portion underlying one of the edge panels, and an indicator member mounted on each of the spring clips and alignable with selected yard marking indicia.

2. A display as in claim 1 wherein at least one of the clips includes a pair of clamp plates, spring means urging edges of the clamp plates into gripping relation, a card attached to one of the clamp plates with a portion of the card extending outwardly therefrom and overlying the main panel, and indicia on the card cooperating with the indicia on the main panel.

3. A display as in claim 2 wherein the outwardly extending portion of the card extends in face-to-face relation with the main panel.

* * * * *